US005167579A

United States Patent [19]

Rotter

[11] Patent Number: 5,167,579

[45] Date of Patent: Dec. 1, 1992

[54] ROOF VENT OF SYNTHETIC FIBER MATTING

[76] Inventor: Martin J. Rotter, 115 Lismore Ave., Glenside, Pa. 19038

[21] Appl. No.: 745,573

[22] Filed: Aug. 15, 1991

[51] Int. Cl.[5] ..... F24F 7/02

[52] U.S. Cl. ..... 454/365; 52/199

[58] Field of Search ..... 52/57, 199; 55/524, 55/527; 98/42.01, 42.2, 42.21

[56] References Cited

U.S. PATENT DOCUMENTS

| | | | |
|---|---|---|---|
| 4,227,899 | 10/1980 | Meny et al. | 55/524 X |
| 4,701,197 | 10/1987 | Thornton et al. | 55/521 X |
| 4,746,430 | 5/1988 | Cooley | 55/158 X |
| 4,765,915 | 8/1988 | Diehl | 55/524 X |
| 4,838,905 | 6/1989 | Billier et al. | 55/524 X |
| 4,876,950 | 10/1989 | Rudeen | 98/42.21 |
| 4,942,699 | 7/1990 | Spinelli | 98/42.21 X |
| 5,033,465 | 7/1991 | Braun et al. | 55/524 X |

*Primary Examiner*—Harold Joyce

*Attorney, Agent, or Firm*—Seidel, Gonda, Lavorgna & Monaco

[57] ABSTRACT

A roof venting system of the ridge vent type, the improvement comprising a unique mat covering the ridge slot. The mat is a unitary sheet construction of randomly aligned synthetic fibers which are opened and blended, randomly aligned into a web by airflow, joined by phenolic or latex binding agents and heat cured to produce an air-permeable varying mesh. The unitary mat provides the desirable physical properties such as tensile strength, resilience, ability to be transported in rolls and cut to length, ease of joining strips, long term durability in local ambient conditions, water and insect barrier, and low profile, without requiring sheets of dissimilar materials to be bonded together to provide such properties.

6 Claims, 2 Drawing Sheets

ROOF VENT OF SYNTHETIC FIBER MATTING

FIELD OF THE INVENTION

This invention is related to the general field of roof ventilation systems. It is particularly related to roof ridge ventilators.

BACKGROUND OF THE INVENTION

It has been a long known practice to ventilate attics under gable roofs by running a vent along the roof ridge. Such vents are created during construction by sizing the uppermost row of sheeting panels to leave an open slot running along the ridge essentially the length of the roof. The slot creates effective heat ventilation by convection flow and suction caused by wind across the roof ridge.

Soffit ventilators are perforated or louvered openings in the underside (soffit) of the eaves of an overhanging roof. The vents allow fresh ambient air to flow into the attic to equalize attic temperature and pressure with the outside. This equalization inhibits moisture from condensing on insulation and wood roofing materials which causes mildew and rot, prevents build-up of ice dams which could buckle shingles and gutters, and reduces air-conditioning costs when hot attic air is replaced by cooler ambient air.

A soffit ventilation system works in conjunction with a ridge vent to provide passive ventilation. As hot stale air is withdrawn from the ridge slot vent by convection and/or wind suction, it is replaced by fresh ambient air through the soffit vents.

Differences between the various types of ridge vents have been primarily in the capping structures used over the vent slot to exclude water and pests. Early capping structures were often metal hoods, or "ridge caps", extending wider than the slot and having some combination of baffles and screens to exclude water and insects. Representative examples may be seen in U.S. Pat. Nos. 2,214,183 (Seymour) and 2,160,642 (Bumpas). More advanced ridge caps have used, louvers, as seen in U.S. Pat. Nos. 3,683,785 (Grange) and 4,558,637 (Mason).

Other capping structures place some type of porous material over the slot, which is then covered by the same roofing material as the rest of the roof, such as shingles or tiles. For example, U.S. Pat. No. 3,949,657 (Sells) shows using a matrix of either molded plastic or corrugated cardboard dipped in epoxy as the porous material, with shingles nailed over the matrix leaving the side edges open to vent hot air. The relatively large size and straight line orientation of the pores in this corrugated material apparently permitted wind-driven rain to back flow into the slot, as it has since been found an improvement to include a metal flashing strip with small vent holes at least on the windward side (U.S. Pat. No. 4,843,953, again Sells). Essentially similar is the corrugated polyethylene sheet material shown in patent 4,803,813 (Fiterman).

Materials having smaller and more convoluted air passages than the corrugated materials provide a more effective barrier against wind-driven water and small insects. Non-woven fiber mats and open-cell plastic foam are inexpensive materials of this description which have been used in roof ventilators. In U.S. Pat. No. 4,325,290 (Wolfert), a non-woven fiber mat is used as a filter in a vent cap system. In U.S. Pat. No. 4,942,699 (Spinelli), a thin non-woven fiber sheet is bonded to matting of nylon filaments to provide sufficient structural resilience to allow the sheet to be used under shingles. In U.S. Pat. No. 4,876,950 (Rudeen), two strips of open-cell plastic foam are joined to an impermeable plastic membrane again two parallel for use under shingles.

It is apparent from the above that inventions in the field of roof ridge vents have largely evolved from the availability of new materials, and the ingenuity of inventors in adapting such materials for venting. Without attempting to provide a exhaustive listing of desirable properties, it can generally be observed that a venting material must be sufficiently air-permeable to provide heat ventilation, but still prevent the entry of small insects, dust, and water. Consequently, materials having small convoluted air passages and non-wicking characteristics, such as non-woven fiber sheets and open-cell foam, are good candidates. But such materials should also demonstrate other mechanical and chemical properties such as tensile strength, resilience, ability to be transported in rolls and cut to length, ease of joining strips, and long term durability in local ambient conditions.

With prior vent systems, as described above, these additional properties have been achieved by laminating fiber sheets or foam strips to other materials, such as nylon matting (Spinelli) or plastic membrane (Rudeen). However, such composite materials frequently compromise some features in order to achieve others. For example, the lamination of nylon matting to the fiber sheet, as described in the Spinelli patent, gives the sheet a needed thickness and resilience, but complicates its ease of application. When the laminated material is unrolled for installation, the nylon matting must be cut back from the edge at the ends and sides, and the non-woven fiber sheet wrapped up around the sides of the matting to create a barrier against water and insects. To join two strips of the laminated material, the nylon matting must also be cut away on one sheet, and the two sheets then lapped and joined by adhesive. Moreover, even though the matting is bonded to the sheet on either side of a central hinge line, it is possible for workmen unfamiliar with the material to install it upside down; that is, with the sheet side over the matting, instead of underneath it. The potential for this error can be seem by comparing the nylon matting laminated material (Spinelli) to the plastic membrane material (Rudeen); the former is installed with the nylon matting side down, while the later is installed with the plastic membrane up. A worker experienced with only one of these materials could easily be led by his experience to install the other inverted.

SUMMARY OF THE INVENTION

The present invention provides an improved roof ridge venting system using a unitary mat made of randomly-aligned synthetic fibers joined by phenolic or latex binding agents and heat cured to provide a mat with a varying mesh. Under a standard compression test of 1360 grams, the mat exhibits a compression of 13% and a recovery of 100%. Tensile strength is 55 psi in the long direction and 64 psi in the cross direction. Such mat provides a simplified method of installation in that it can simply be cut to length from a roll and installed over the ridge slot, with the capping shingles or tiles nailed on top of it. If it is necessary or desirable to join sections of the material, such joinder can be made by merely coating the abutting ends to be joined with synthetic rubber sealant used for bonding asphalt shingles and sealing around flashing, or any other suitable caulk or adhesive.

BRIEF DESCRIPTION OF THE DRAWINGS

For the purpose of illustrating the invention, the drawings show a form which is presently preferred; it being understood, however, that this invention is not limited to the precise arrangements and instrumentalities shown.

DESCRIPTION OF THE PREFERRED EMBODIMENT

Figure 1:
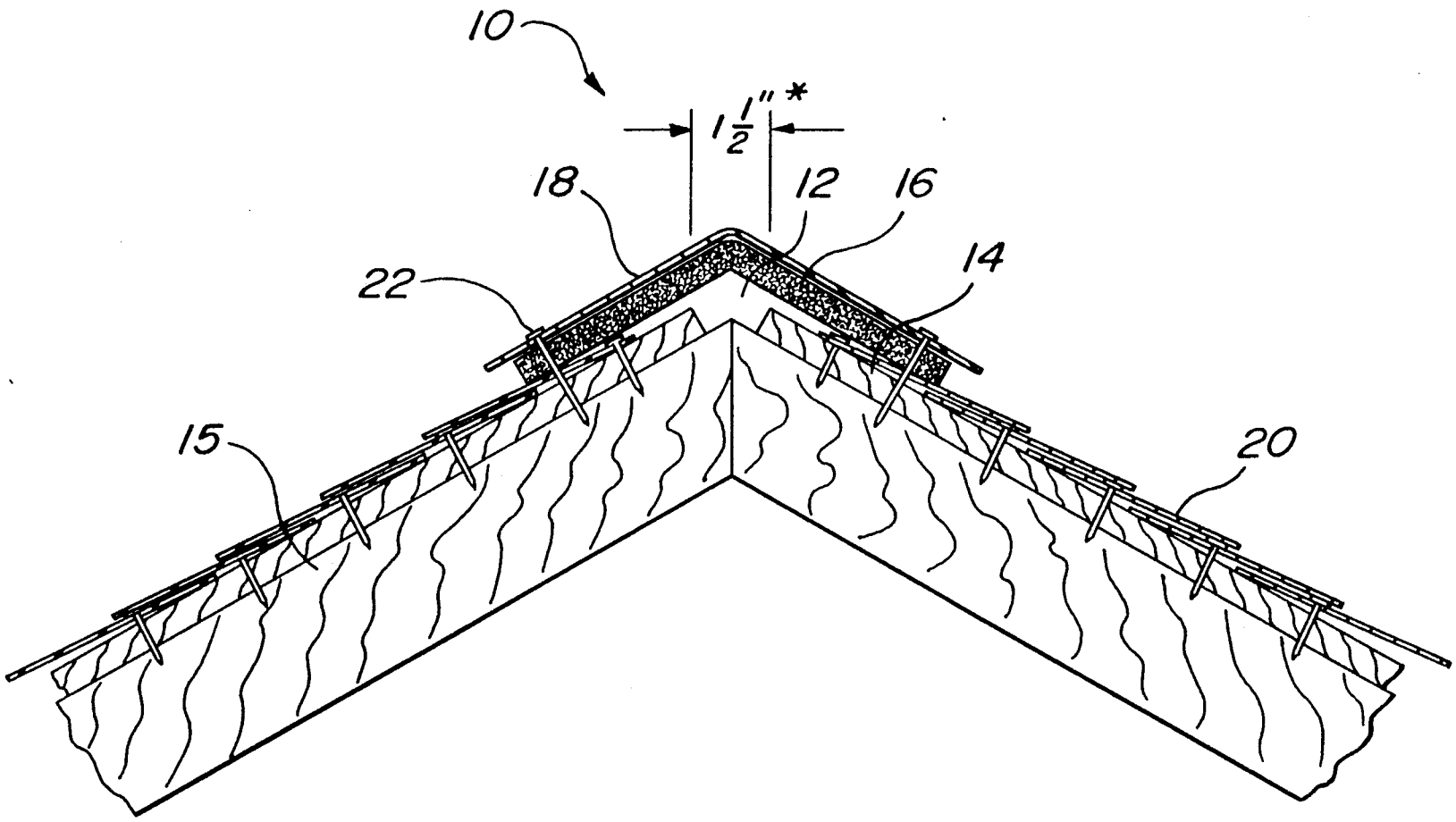
FIG. 1 is a sectional view taken at the ridge of a roof, showing a ridge vent using a unitary mat according to the present invention.

In FIG. 1, a venting system 10 according to the invention is used to vent hot air from an attic through a slot 12 in the ridge of a roof. In original construction, the slot 12 is formed by cutting the upper row sheeting panels 14 approximately ¾ to 1 inch short of the ridge crest formed by the rafters 15 in a roof truss, as shown in FIG. 1 (1¾ to 2 inches if a ridge pole is used). In existing structures, the slot can be formed by cutting away the same size strip from the sheeting at the ridge on both sides, taking care not to damage the rafters or a ridge pole, and terminating about six inches from the front and back sides of the roof.

As known to those in the art, a vent along the ridge of a gable roof is effective in drawing hot stale air out of the interior space covered by the roof, usually an attic. Convection flow draws the highest temperature air to the ridge crest and out the vent. Wind across the vent line is directed up and over the vent by the sloping sides of the roof, creating a lowered pressure at the vent which draws air out of the attic even when there is little convection current. When combined with soffit vents under the eaves to draw fresh air, a ridge vent usually provides more effective attic ventilation than turbine vents or large vent cans. However, the effectiveness of the vent depends upon the degree to which convection outflow and wind across the vent line is uninhibited by the vent structure. Most effective would be a completely uncovered vent, but the need to keep out rain water, dirt and pests requires some sort of covering structure. The design considerations for a covering structure are, therefore, to maximize convection outflow and wind suction, establish an effective barrier against water, dirt and insect entry, maintain aesthetic appearance and long term durability, while providing low cost and ease of installation.

The present invention meets these design parameters by providing a unitary mat 16 made of randomly aligned synthetic fibers joined by phenolic or latex binding agents and heat cured to provide a mat with a varying mesh. Under a standard compression test of 1360 grams, the mat has a compression of 13% and a recovery of 100%. Tensile strength is 55 psi in the long direction and 64 psi in the cross direction. As used herein, the term "unitary" is intended to mean that the mat material is of unitary sheet construction, rather than dissimilar sheets laminated or otherwise bonded together. It does not exclude joining strips of the material with roofers caulk or other adhesive as described in subsequent paragraphs.

The mat 16 is a continuous strip preferably about 10½ inches wide and ⅝th inch thick. It thus runs the length of the slot, overlapping the slot evenly on each side 12, and is of such low profile that it does not attract attention when covered by shingles or tiles of the same color and texture as used on the rest of the roof, such as cap shingle 18 of FIG. 1.

Figure 2:
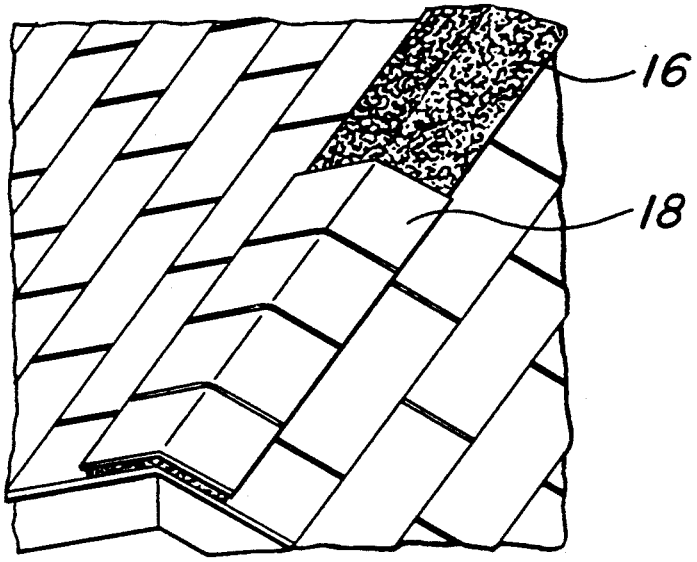
FIG. 2 is a perspective view of a partially-installed roof ridge vent according to the present invention.

Roof shingles 20 are laid in overlapping rows in the conventional manner up to the slot 12. As depicted in FIGS. 1 and 2, the mat 16 may easily laid by unwinding one end of the material from a roll and centering it over the slot at one end, then unrolling it in a continuous strip to the other end where it is cut from the roll. Starting from one end and working to the other, each cap shingle 18 is then laid over the mat 16 and overlaps the edge of the preceding cap shingle, and secured by driving roofing nails 22 through the cap shingle 18, mat 16 and roof shingle 20 into the underlying sheeting 14 and rafters 15.

The mat 16 is sufficiently resistant to compression that the installer can easily feel when the shingle 18 is pressed firmly against the mat, and sink the nail 20 only until the nail head is against the shingle, leaving the cap raised about ⅝ inch above the underlying roof shingles. At most lines of sight and distances on the ground around the building, the ⅝ inch rise is indistinguishable from the surface of the roof. Further , the low profile of the vent does not significantly disrupt wind current across the ridge line, which promotes the lowered pressure at the vent exits and resulting suction of attic air through the vent.

Figure 3:
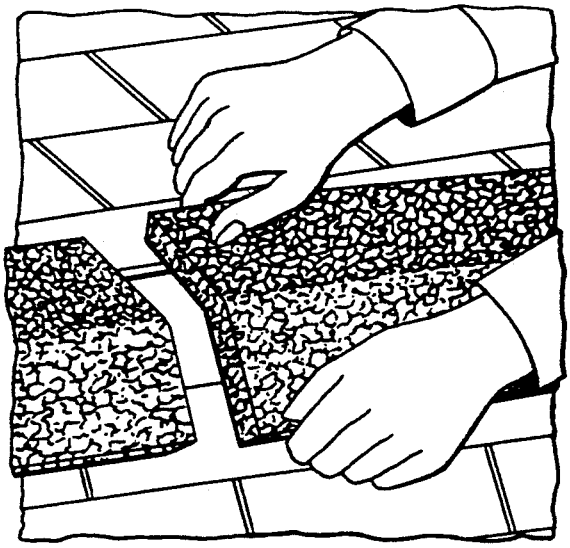
FIG. 3 is a perspective view of two strips of mat material being joined end-to-end to install a roof vent according to the present invention.

The mat 16 provides a simplified method of installation in that it can simply be cut to length from a roll and installed over the ridge slot, with the capping shingles or tiles nailed on top of it. If it is necessary or desirable to join strips of the material, such joinder can be made by merely coating the abutting ends with synthetic rubber sealant used for bonding asphalt shingles and sealing around flashing, or any other suitable caulk or adhesive, and abutting the strips end-to-end as shown in FIG. 3.

The mat 16 is made of non-woven synthetic fiber mesh of a type that has been used in other applications for scrubbers and polishers. Synthetic fibers (usually nylon or polyester) are opened and blended, then randomly aligned into a web by airflow. The web is then treated with binding agents of water based phenolics and latexes. The treated web is then oven-cured to bind the fibers into a relatively rigid mat having a significant porous area between the random fibers 12. An example of such mat is M29 polyester scrubber pads made by Loren Products Division of Atochem North America Inc.

The presently preferred material for mat 16 is similar to the above M29 except that aluminum oxide is substituted in the binder, and the web is produced as a ⅝ inch deep, 10½ inch wide strip on 20 foot or 50 foot rolls. Its specifications are as follows:

| | |
|---|---|
| Ounce Weight (sq. yd.) | 40.5–45.0–49.5 |
| Thickness (mm) | 15.9–17.5–19.9 |
| Binder % | 23.55–26.17–27.79 |
| Fiber Type | Polyester |
| Fiber Size | 200 denier |
| Fiber Percent | 25.71–28.57–31.43 |

-continued

| | |
|---|---|
| Mineral Type | $AlO_2$ (ave mesh 140) |
| Mineral Percent | 40.7–45.3–49.9 |
| Break Machine Direction | 30.0 psi minimum |
| Cross Direction | 30.0 psi minimum |
| Tear Machine Direction | 30.0 psi minimum |
| Cross Direction | 30.0 psi minimum |
| Water Penetration | 30 seconds minimum |

The mat material also has the following properties, as determined through ASTM and other standard tests:

| Property | Test | Value |
|---|---|---|
| Air permeability | ASTM D737 | 760 (cu. ft./min.) |
| Tear Strength | ASTM D1294-86 | |
| Machine | | 42 psi. |
| Counter | | 35.5 psi. |
| Tensile Strength | ASTM D2261-83 | |
| Machine | | 55 psi. |
| Counter | | 64 psi. |
| Self Ignition Temp. | ASTM D1929 | 963 deg. F. |
| Cold Crack Resistance | C-115 | −25 deg. F. |

The polyester fiber and binder material create a non-wicking mat, which, when installed as described above, is an effective barrier against wind-driven rain. A section of mat was subjected to a wind-driven rain test simulating the extreme condition of an 8 inch per hour rainfall at 100 m.p.h. wind, in which water was added to the airstream up-wind of a mat specimen mounted on a 3 inch by 12 inch slopped roof. The specimen was subjected to incrementally increased wind speeds for the periods noted below:

| Wind Speed | Duration (minutes) |
|---|---|
| 50 | 5 |
| 60 | 5 |
| 70 | 5 |
| 80 | 1 |
| 90 | 1 |
| 100 | 1 |
| | 12 minutes total |

No damage or failure was evident and no leakage occurred.

The mat further exhibits sufficient compression resistance to provide a structural base for the cap shingles. A section of mat was subjected to a static pressure structural uplift test in which the specimen was subjected to upward acting static pressure loads of 28.5 and 57 lbs. per square foot. The mat was installed over a 1½ inch wide and 5 inch long ventilation slot using 2 inch roofing nails at about 5 inch centers for each shingle, thereby providing four nails per foot on each side of the vent. No damage or failures were observed.

The material is durable against ultra violet light deterioration which degrades most nylon and polyester fiber materials over time. A section of mat was subjected to a UV stability test in which a mat was placed within a UV chamber and subjected to constant UV exposure for 1000 hours. No significant change of properties was observed.

The present invention may be embodied in other specific forms without departing from the spirit or essential attributes thereof and, accordingly, reference should be made to the appended claims, rather than to the foregoing specification, as indicating the scope of the invention.

I claim:

1. A roof venting system comprising:

an open slot along substantially the length of a roof ridge permitting ventilation from the interior space under the roof to the exterior;

a mat covering the slot over the length of the slot and overlapping the slot evenly on each side, the mat being constructed of randomly aligned synthetic fibers which are opened and blended, randomly aligned into a web by airflow, joined by phenolic or latex binding agents and heat cured to produce an air-permeable varying mesh, said mat being of unitary sheet construction having no dissimilar sheets laminated or otherwise bonded together;

a capping structure overlying the mat and spaced away from the roof by the thickness of the mat to provide ventilation through the mat in the space between the capping structure and the roof.

2. A roof venting system as in claim 1, wherein the capping structure comprises a plurality of shingles secured over the mat by nails driven through the mat into the underlying roof.

3. A roof venting system as in claim 1, wherein the mat is approximately ⅝th inch thick.

4. A roof venting system as in claim 1, wherein the varying mesh acts as a barrier to inhibit the entry of insects, dust, and water through the vent into the interior space under the roof.

5. In a roof venting system of the type in which an open slot along substantially the length of a roof ridge permits ventilation from the interior space under the roof to the exterior, an air permeable and resilient material overlies the slot to permit ventilation while excluding water and insects from entering through the slot and to provide spacing between the slot and capping materials, and capping materials covering said air permeable and resilient materials, the improvement comprising:

said air permeable and resilient material being a mat constructed of randomly aligned synthetic fibers which are opened and blended, randomly aligned into a web by airflow, joined by phenolic or latex binding agents and heat cured to produce a varying mesh, said mat being of unitary sheet construction having no dissimilar sheets laminated or otherwise bonded together.

6. A roof venting system as in claim 5, wherein the varying mesh acts as a barrier to inhibit the entry of insects, dust, and water through the vent into the interior space under the roof.

* * * * *